US012076629B2

(12) United States Patent
Lupan et al.

(10) Patent No.: US 12,076,629 B2
(45) Date of Patent: Sep. 3, 2024

(54) PORTABLE SYSTEMS METHODS AND COMPUTER STORAGE MEDIA FOR SPARRING TRAINING

(71) Applicants: Omri Lupan, Gan Yavne (IL); Natan Levy, Ljublijana (SI)

(72) Inventors: Omri Lupan, Gan Yavne (IL); Natan Levy, Ljublijana (SI)

(73) Assignee: Boxing Buddy, Newark, DE (US)

( * ) Notice: Subject to any disclaimer, the term of this patent is extended or adjusted under 35 U.S.C. 154(b) by 280 days.

(21) Appl. No.: 17/536,399

(22) Filed: Nov. 29, 2021

(65) Prior Publication Data

US 2023/0166171 A1 Jun. 1, 2023

(51) Int. Cl.

| | |
|---|---|
| ***A63B 69/24*** | (2006.01) |
| ***A63B 24/00*** | (2006.01) |
| ***A63B 69/34*** | (2006.01) |

(52) U.S. Cl.

CPC ..... *A63B 69/244* (2022.08); *A63B 24/0003* (2013.01); *A63B 24/0021* (2013.01); *A63B 24/0075* (2013.01); *A63B 24/0087* (2013.01); *A63B 69/34* (2013.01); *A63B 2024/0025* (2013.01); *A63B 2220/80* (2013.01); *A63B 2244/10* (2013.01)

(58) Field of Classification Search

CPC ..... A63B 69/244; A63B 24/0003; A63B 24/0021; A63B 24/0075; A63B 24/0087; A63B 69/34; A63B 2024/0025; A63B 2220/80; A63B 2244/10

See application file for complete search history.

(56) References Cited

U.S. PATENT DOCUMENTS

| | | | | |
|---|---|---|---|---|
| 9,744,420 | B1 * | 8/2017 | Bergamini | A63B 69/22 |
| 10,252,135 | B1 * | 4/2019 | Roberts | A63B 69/244 |
| 2004/0224826 | A1 * | 11/2004 | O'Shea | A63B 69/222 482/83 |

* cited by examiner

*Primary Examiner* — Sundhara M Ganesan
*Assistant Examiner* — Jacqueline N L Loberiza
(74) *Attorney, Agent, or Firm* — Mark S. Cohen; PEARL COHEN ZEDEK LATZER BARATZ LLP

(57) ABSTRACT

A system for sparring training comprises a portable device for controlled sparring, a plurality of punching arms assemblies, at least one power source; a method for sparring training comprising providing a punching bag, providing a system for sparring training, mounting the system onto the punching bag, supplying electrical energy to the portable device, initiating a workout program, generating a sequence of movements of the plurality of the punching arms assemblies; a computer-readable storage medium causing the system for sparring training to controllably supply electrical energy to the motor, perform a predefined workout program, generate a sequence of movements of the plurality of punching arms assemblies.

20 Claims, 5 Drawing Sheets

PORTABLE SYSTEMS METHODS AND COMPUTER STORAGE MEDIA FOR SPARRING TRAINING

TECHNICAL FIELD

In general, the present invention pertains to the art of sparring training. In particular, the invention relates to portable systems methods and computer storage media for sparring training.

BACKGROUND ART

The current state-of-the-art typically includes sparring training devices that are passive, bulky and heavy, for example punching bags and human shaped dummies. Although there are active sparring training systems as well, usually embodied as human shaped robots, which react to the trainee actions and may punch back, such sparring training systems are typically cumbersome, non-portable and expensive.

It is believed that the current state of the art is represented by the following literature: EP0173129, US2004224826, KR20170089489, US2017095719, U.S. Pat. No. 5,800,319, US2014155228, US2014378281, U.S. Pat. No. 4,088,315, WO2014146136, CN104971502 and TWM436481.

US20040224826 describes a motorized punching bag apparatus consisting of a support with a motorized rotating arm simulating sparring to which a punching bag is attached. The arm in US20040224826 can be controlled using electronics and microprocessors. Notably the motorized apparatus of US20040224826 is a non-portable apparatus where the origin of the arm is fixed.

US2014378281 describes a robotic sparring partner, having an upright torso section operatively engaged with arms, legs, and a head. Both the arms and legs in US2014378281 are formed of two sections and engaged to the torso at respective shoulder and hip positions. Computer controlled electric motors in US2014378281 at points similar to human joints provide rotation of joined leg and arm sections in two planes. A computerized controller in US2014378281 is configured with software to elicit human like offensive and counter movements of the limbs of the sparring device in response to, or an offensive movement toward a human sparring partner. US2014378281 uses predictive software in order to react or act, actively track the human user in order to do so.

US2014155228 describes a training dummy, the arms of which are constructed in a manner which limits their motion to specific movements.

U.S. Pat. No. 5,800,319 describes a belt with arms which can be installed on punching bags.

U.S. Pat. No. 4,088,315 describes a sparring dummy with hot spots which light-up when the user hits them and can give feedback regarding strength and efficiency.

CN104971502A describes a robot designed to mimic a boxer.

SUMMARY OF THE INVENTION

The following summary of the invention is provided in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

The invention was made in view of the deficiencies of the prior art and provides systems, methods and processes for overcoming these deficiencies.

According to some embodiments and aspects of the present invention, there is provided a system for sparring training.

According to some embodiments of the present invention, the system for sparring training comprises: a portable device for controlled sparring comprising: a fastener configured for mounting onto a punching bag, the fastener is configured to assume an open configuration, in which the fastener is configured to be threaded but not screw-threaded onto the punching bag and/or removed from the punching bag, and a closed configuration, in which the fastener is configured to preclude said fastener from being removed from the punching bag; an interconnection mechanism configured for securing the fastener in the closed configuration.

According to some embodiments of the present invention, the system for sparring training comprises a plurality of punching arms assemblies, in which each one of the punching arms assemblies comprises: a mounting plate configured to be firmly attachable to the fastener; a motor housing configured to be mounted onto the mounting plate; an electric motor, encased within the motor housing; a gearing mechanism, operationally connectable to the electric motor; a rod holder operationally connectable to the gearing mechanism; a punching rod comprising at least one axle, in which a proximal portion of the axle is configured for attachment to the rod holder. According to some embodiments of the present invention, the system for sparring training comprises at least one power source, operationally connectable to the electric motor, configured for supplying electrical energy to the system.

In accordance with some aspects and embodiments of the present invention, there is provided a system for sparring training, in which the system further comprises a punching bag.

In accordance with some aspects and embodiments of the present invention, there is provided a system, in which the punching bag comprises a speed bag, maize bag, slip nag, heavy bag, freestanding heavy bag, uppercut bag, wall bag.

In accordance with some aspects and embodiments of the present invention, there is provided a system, in which the fastener comprises a firm and flexible material.

In accordance with some aspects and embodiments of the present invention, there is provided a system for sparring training, in which the system further comprises a screw, rivet, adhesive, bolt, bracket, mechanical fasteners, snap buttons, hook and loop fasteners, hooks, configured for removably attaching the mounting plate to the fastener and/or for removably attaching the ends of the fastener by interconnecting them.

In accordance with some aspects and embodiments of the present invention, there is provided a system for sparring training, in which the system further comprises a screw, rivet, adhesive, bolt, bracket, mechanical fasteners, snap buttons, hook and loop fasteners, hooks, configured for removably attaching the mounting plate to the fastener.

In accordance with some aspects and embodiments of the present invention, there is provided a system for sparring training, in which the system further comprises a securing mechanism configured for removably attaching the plurality of punching arms assemblies to the gearing mechanism.

In accordance with some aspects and embodiments of the present invention, there is provided a system, in which each one of plurality of punching arms assemblies further include a hinge cap, configured for providing protective cover to a driving hinge of the gearing mechanism.

In accordance with some aspects and embodiments of the present invention, there is provided a system for sparring training, in which the system further comprises an electronic card and a microprocessor, configured for operating the system in a preprogrammed operational mode.

In accordance with some aspects and embodiments of the present invention, there is provided a system, in which at least one power source comprises a plurality of power source housings.

In accordance with some aspects and embodiments of the present invention, there is provided a system for sparring training, in which the system further comprises a plurality of power source housings, in which each one of plurality of power source housing is associated with a respective punching arms assembly, of plurality of punching arms assemblies.

According to some embodiments and aspects of the present invention, there is provided a method for sparring training. According to some embodiments of the present invention, the method for sparring training comprising: providing a punching bag; providing a system for sparring training comprises: a portable device for controlled sparring comprising: a fastener configured for mounting onto a punching bag, in which the fastener is configured to assume: an open configuration and a closed configuration; an interconnection mechanism configured for securing the fastener in the closed configuration; a plurality of punching arms assemblies, in which each one of the punching arms assemblies comprises: a mounting plate configured to be firmly attachable to the fastener; motor housing configured to be mounted onto the mounting plate; an electric motor, encased within the motor housing; a gearing mechanism, operationally connectable to the electric motor; a rod holder operationally connectable to the gearing mechanism; a punching rod comprising at least one axle, in which a proximal portion of the axle is configured for attachment to the rod holder; at least one power source, operationally connectable to the electric motor, configured for supplying electrical energy to the system.

According to some embodiments of the present invention, the method of sparring training comprising mounting the system onto the punching bag; supplying electrical energy to the portable device; initiating a workout program and/or generating a sequence of movements of the plurality of punching arms assemblies.

In accordance with some aspects and embodiments of the present invention, the method of sparring training further comprises detecting a user presence.

In accordance with some aspects and embodiments of the present invention, the method of sparring training further comprises removably attaching the motor housing to the mounting plate.

In accordance with some aspects and embodiments of the present invention, the method of sparring training further comprises removably attaching the rod holders to the gearing mechanism.

In accordance with some aspects and embodiments of the present invention, the method of sparring training further comprises mounting a hinge cap on a driving hinge of the gearing mechanism.

In accordance with some aspects and embodiments of the present invention, the method of sparring training further comprises preprogramming the system with a desired operational mode and/or feeding a workout program into a control module using digital communication.

In accordance with some aspects and embodiments of the present invention, the method of sparring training further comprises selecting a specific workout program.

In accordance with some aspects and embodiments of the present invention, the method of sparring training further comprises the step of collecting data.

According to some embodiments and aspects of the present invention, there is provided a computer-readable storage medium, having computer-executable instructions stored thereon which, when executed by a computer microprocessor of a system for sparring training, comprising a portable device mountable on a punching bag, in which the portable device comprising: a fastener configured for mounting onto the punching bag, in which the fastener is configured to assume an open configuration, in which the fastener is configured to be threaded but not screw-threaded onto the punching bag and/or removed from the punching bag and a closed configuration, in which the fastener is configured to preclude said fastener from being removed from the punching bag; an interconnection mechanism configured for securing the fastener in the closed configuration; a plurality of punching arms assemblies on the portable device, in which one of the punching arms assemblies comprises: a mounting plate configured to be firmly attachable to the fastener; a motor housing configured to be mounted onto the mounting plate; an electric motor, encased within the motor housing; a gearing mechanism, operationally connectable to the electric motor; a rod holder operationally connectable to the gearing mechanism; a punching rod comprising at least one axle, in which a proximal portion of the axle is configured for attachment to the rod holder; at least one power source, operationally connectable to the electric motor, configured for supplying electrical energy to the system, causing the system for sparring training to: controllably supply electrical energy to the motor; perform a predefined workout program; generate a sequence of movements of the plurality of punching arms assemblies.

According to some preferred embodiments and aspects of the present invention, there is provided a computer-readable storage medium further comprising computer-executable instructions, causing the system for sparring training to detect user presence; collect data; selecting a specific workout program; preprogramming the system with a desired operational mode; feeding a predefined workout program into a control module; operating a digital communication port; interactively responding to movements of a user.

Definitions

The term punching bag as referred to herein is to be construed as encompassing any type of boxing and/or sparring training device, in a non-limiting manner including: a speed bag, maize bag, slip nag, heavy bag, freestanding heavy bag, uppercut bag, wall bag.

The term power source, as referred to herein, in a non-limiting manner includes: a rechargeable battery, non-rechargeable battery, magnetic induction coil, wired connection, an electric socket such as: micro-USB, mini-USB and USB-C.

Whenever the terms "server", "agent", "system" or "module" is used herein, it should be construed as a computer program, including any portion or alternative thereof, e.g. script, command, application programming interface (API), graphical user interface (GUI), etc., and/or computational hardware components, such as logic devices and application integrated circuits, computer storage media, computer micro-processors and random access memory (RAM), a display, input devices and networking terminals, including configurations, assemblies or sub-assemblies thereof, as well as any combination of the former with the latter.

The term storage as referred to herein is to be construed as including one or more of volatile or non-volatile memory, hard drives, flash storage devices and/or optical storage devices, e.g. CDs, DVDs, etc. The term "computer-readable media" as referred to herein can include transitory and non-transitory computer-readable instructions, whereas the term "computer-readable storage media" includes only non-transitory readable storage media and excludes any transitory instructions or signals. The terms "computer-readable media" and "computer-readable storage media" encompass only a computer-readable media that can be considered a manufacture (i.e., article of manufacture) or a machine. Computer-readable storage media includes "computer-readable storage devices". Examples of computer-readable storage devices include volatile storage media, such as RAM, and non-volatile storage media, such as hard drives, optical discs, and flash memory, among others.

The term integrated shall be construed inter alia as operable on the same machine and/or executed by the same computer program. Depending on the actual deployment of the method, its implementation and topology, integration of agents and/or integration into modules as well as the terms "transfer", "relaying", "transmitting", "forwarding", "retrieving", "accessing", "pushed" or similar refer to any interaction between agents via methods inter alia including: function calling, Application Programming Interface (API), Inter-Process Communication (IPC), Remote Procedure Call (RPC) and/or communicating using of any standard or proprietary protocol, such as SMTP, IMAP, MAPI, OMA-IMPS, OMA-PAG, OMA-MWG, SIP/SIMPLE, XMPP, SMPP.

The term network, as referred to herein, should be understood as encompassing any type of computer and/or data network, in a non-limiting manner including one or more intranets, extranets, local area networks (LAN), wide area networks (WAN), wireless networks (WIFI), the Internet, including the world wide web, and/or other arrangements for enabling communication between the computing devices, whether in real time or otherwise, e.g., via time shifting, cashing, batch processing, etc.

The terms notification and/or message as used herein refer to a communication provided by a notification system to a message recipient device. A notification and/or message may be used to inform one or more recipient device, for example a notification and/or messages may be provided to the one or more recipient device, in a non-limiting manner using SMS texts, MMS texts, E-mail, Instant Messages, mobile device push notifications, HTTP requests, voice calls, telephone calls, Voice Over IP (VOIP) calls or alike, library function calls, API calls, predefined protocol, URLs as well as any signals transferred, transmitted or relayed, as defined herein or any combination thereof.

Whenever in the specification hereunder and particularly in the claims appended hereto a verb, whether in base form or any tense, a gerund or present participle or a past participle are used, such terms as well as preferably other terms are to be construed as actual or constructive, meaning inter alia as being merely optionally or potentially performed and/or being only performed anytime in future. The terms essentially and substantially, or similar relative terms, are to be construed in accordance with their ordinary dictionary meaning, namely mostly but not completely.

As used herein, the term "or" is an inclusive "or" operator, equivalent to the term "and/or," unless the context clearly dictates otherwise; whereas the term "and" as used herein is also the alternative operator equivalent to the term "and/or," unless the context clearly dictates otherwise.

It should be understood, however, that neither the briefly synopsized summary nor particular definitions hereinabove are not to limit interpretation of the invention to the specific forms and examples but rather on the contrary are to cover all modifications, equivalents and alternatives falling within the scope of the invention.

DESCRIPTION OF THE DRAWINGS

The present invention will be understood and appreciated more comprehensively from the following detailed description taken in conjunction with the appended drawings in which.

Figure 1:
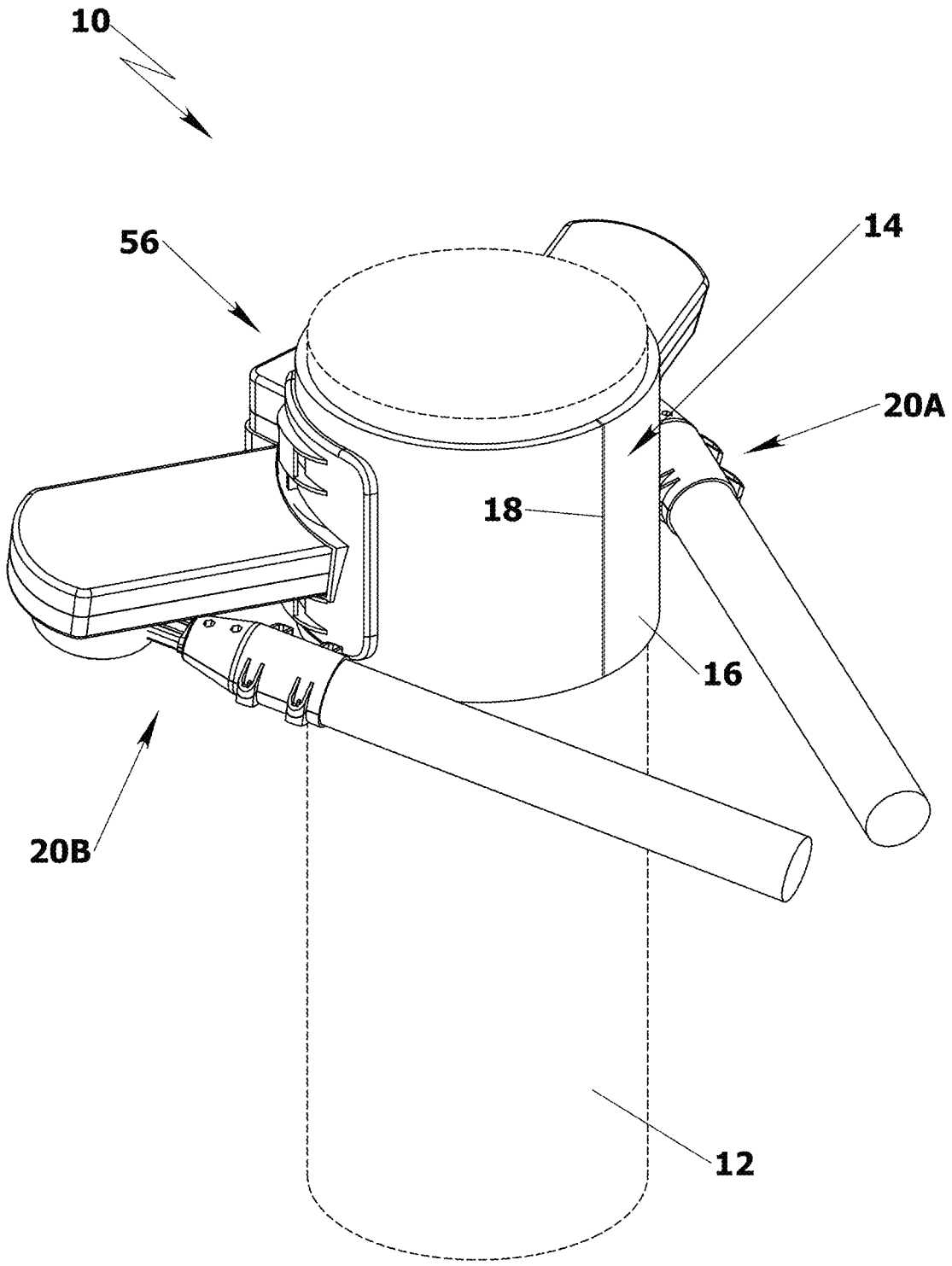
FIG. 1 is an isometric view of a system for sparring training mounted on a punching bag, according to some embodiments of the present invention.

While the invention is susceptible to various modifications and alternative forms, specific embodiments thereof have been shown merely by way of example in the drawings. The drawings are not necessarily complete and not essentially to scale; emphasis instead being placed upon clearly illustrating the principles underlying the present invention.

DETAILED DISCLOSURE OF EMBODIMENTS

Illustrative embodiments of the invention are described below. In the interest of clarity, not all features of actual implementation are described in this specification. It should be appreciated that various features or elements described in the context of some embodiment may be interchangeable with features or elements of any other embodiment described in the specification. Moreover, it will be appreciated that for the development of any actual embodiment, numerous implementation-specific decisions must be made to achieve the developers' specific goals, such as compliance with technology- or business-related constraints, which may vary from one implementation to another, and the effort of such a development might be complex and time-consuming, but would nevertheless be a routine undertaking for those of ordinary skill in the art having the benefit of this disclosure.

Figure 2:
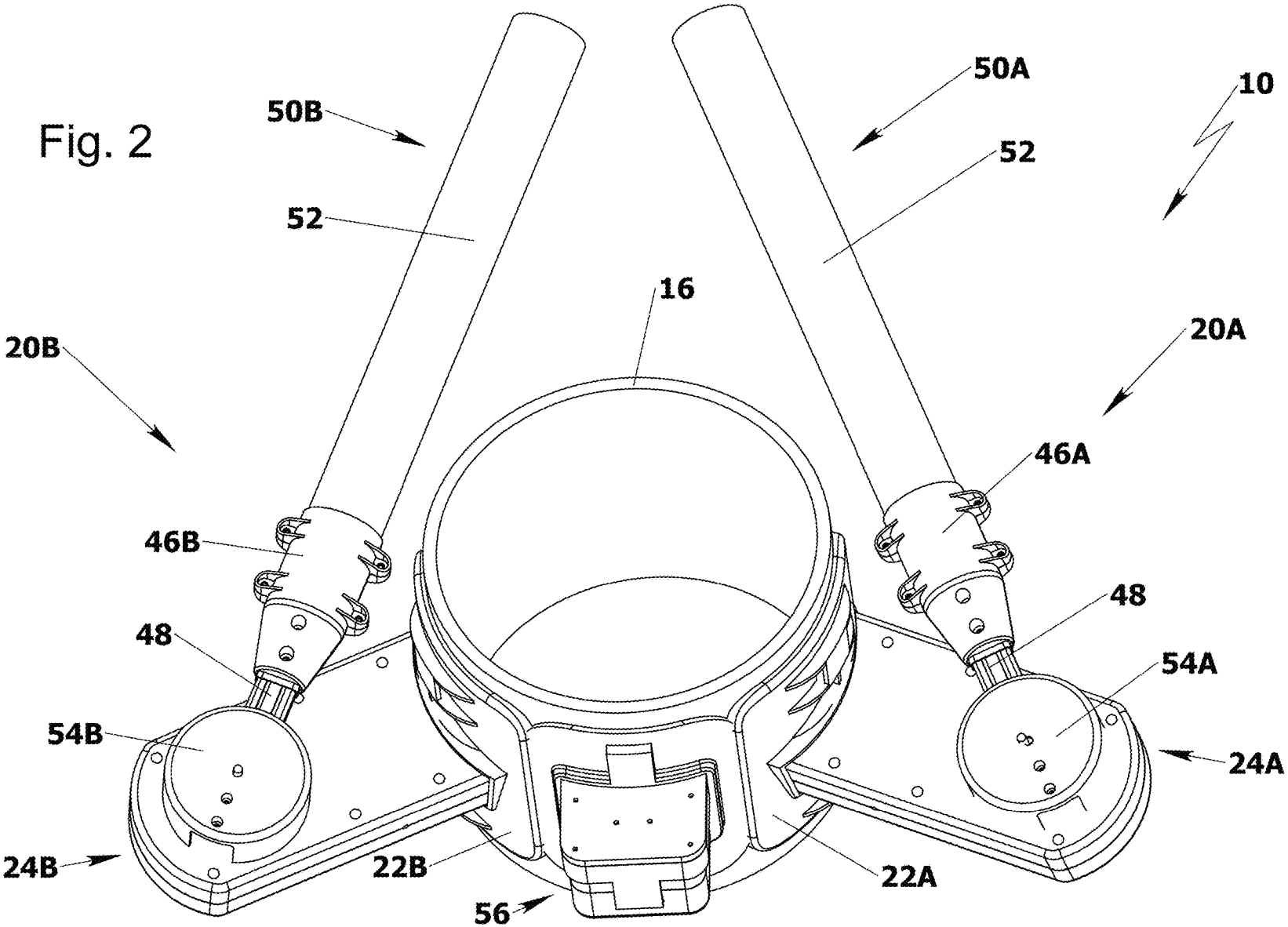
FIG. 2 is a bottom perspective view of the system for sparring training, according to some embodiments of the present invention.
Figure 3:
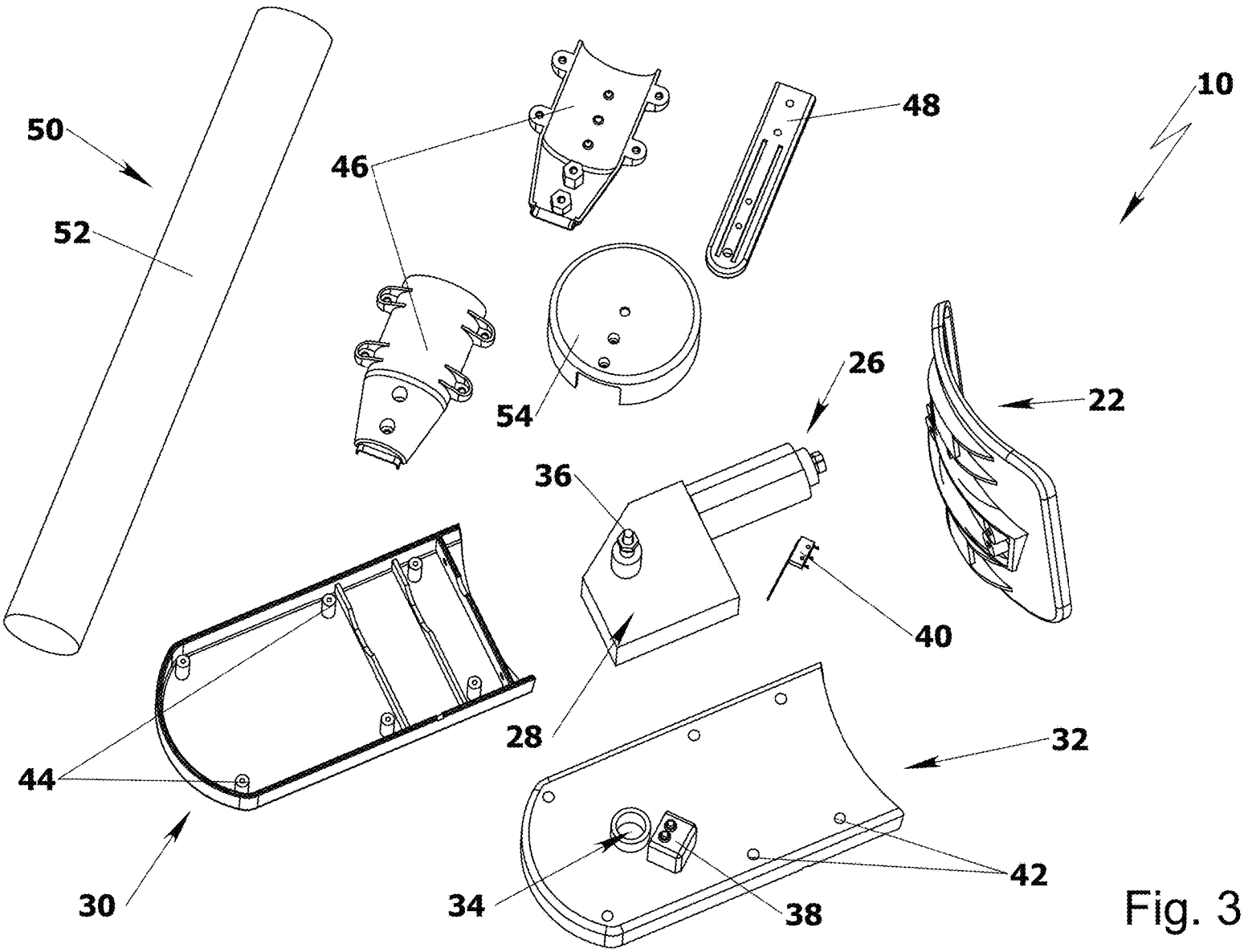
FIG. 3 is an exploded perspective view of the constituent parts of the system for sparring training, according to some embodiments of the present invention.

In accordance with some embodiments of the present invention, reference is now made to FIGS. 1 to 3, showing respectively an isometric view of system 10 for sparring training mountable on a punching bag, a bottom perspective view of system 10 for sparring training and an exploded perspective view showing the constituent parts of system 10 for sparring training. In some embodiments, system 10 comprises punching bag 12. Punching bag 12 is configured for mounting system 10 for sparring training thereon. In some examples, punching bag 12 is speed bag, maize bag, slip nag, heavy bag, freestanding heavy bag, uppercut bag, wall bag. In some examples, punching bag 12 is made is made of soft rubber material, synthetic leather, flexible material, rigid material, etc.

In some examples, fastener 16 comprises a firm and flexible material. In some embodiments, fastener 16 is configured to assume an open configuration, in which fastener 16 is configured to be threaded but not screw-threaded onto punching 12 and/or removed from punching bag 12. In some embodiments, fastener 16 is configured to assume a closed configuration, in which fastener 16 is configured to preclude from been removed from punching bag 12.

In some embodiments, portable device 14 of system 10 further comprises interconnection mechanism 18. Interconnection mechanism 18 is configured for securing fastener 16 in the closed configuration. When fastener 16 is mounted on punching bag 12, interconnection mechanism 18 is preferably positioned centrally in respect to a trainee standing in front of punching bag 12, being a reference mark of appropriate working position for the trainee when working with system 10.

In some embodiments, portable device 14 of system 10 further comprises interconnection mechanism 18. Interconnection mechanism 18 is configured for securing fastener 16 in the closed configuration. When fastener 16 is mounted on punching bag 12, interconnection 18 is preferably positioned centrally in respect to a trainee standing in front of punching bag 12, being a reference mark of appropriate working position for the trainee when working with system 10.

In some embodiments, system 10 for sparring training further comprises punching arms assemblies 20A and 20B. Punching arms assemblies 20A and 20B are configured for performing preferably lateral movements, thereby punching the trainee standing in front of punching bag 12. The position of punching arms assemblies 20A and 20B on fastener 16 is preferably adjustable 12 according to trainee preferences.

In some embodiments, punching arms assemblies 20A and 20B respectively comprise mounting plates 22A and 22B. In some embodiments mounting plates 22A and 22B are permanently affixed to fastener 16. In other embodiments mounting plates 22A and 22B are removably attachable to fastener 16. In some examples, mounting plates 22A and 22B in a non-limiting manner are removably attachable to fastener 16 by at least one of: a screw, rivet, adhesive, bolt, bracket, mechanical fasteners, snap buttons, hook and loop fasteners, hooks.

In some embodiments, punching arms assemblies 20A and 20B respectively comprise motor housings 24A and 24B. Motor housings 24A and 24B are configured to be removably mounted onto mounting plates 22A and 22B. In some embodiments, each one of motor housings 24A and 24B of punching arms assemblies 20A and 20B contains electric motor 26. Electric motor 26 is typically encased within each one of motor housings 24A and 24B.

In some embodiments, each of one of punching arms assemblies 20A and 20B comprises gearing mechanism 28. Gearing mechanism 28 is operationally connectable to electric motor 26. Gearing mechanism 28 is configured to confer a rotational movement to each one of axle holders 46B and 46B of punching arms assemblies 20A and 20B. In some embodiments, motor housings 24A and 24B are configured to provide protective shielding to electric motor 26 and gearing mechanism 28.

In some embodiments, each one of motor housings 24A and 24B comprises bottom subpart 30 and top subpart 32. Bottom subpart 30 preferably includes ribs configured to accommodate electric motor 26 and gearing mechanism 28. Top subpart 32 comprises hole 34. Hole 34 is configured to accommodate motor hinge 36 connected to gearing mechanism 28. In some embodiments, top subpart 32 further includes housing 38. Housing 38 is configured to accommodate microswitch 40. Microswitch 40 is configured for signaling system 10 that the punching arms assemblies 20A and 20B have reached a specific threshold position, thereby making system 10 to stop and/or reverse the motor.

In some embodiments, bottom subpart 30 accommodating electric motor 26 and gearing mechanism 28 is assembled with top subpart 32 by screws. A plurality of screws is respectively introduced into plurality of holes 42 positioned on top subpart 32 and screwed in respective positions into a plurality of studs 44 positioned on bottom subpart 30.

In some embodiments, motor housings 24A and 24B are removably mountable on mounting plates 22A and 22B, for instance by a releasable mechanical snap mechanism.

In some embodiments, punching arms assemblies 20A and 20B respectively comprise rod holders 46A and 46B. Each one of rod holders 46A and 46B is operationally connectable to gearing mechanism 28 by hinge associated part 48. The proximal end of hinge associated part 48 is attachable to each rod holders 46A and 46B. The distal end of hinge associated parts 48 is attachable to driving hinge 36 of gearing mechanism 28 by a securing mechanism.

In some embodiments, punching arms assemblies 20A and 20B respectively comprise rods 50A and 50B. Each of rods 50A and 50B comprises at least one axle 52, in which a proximal portion of axle 52 is configured for attachment to each of rod holders 46A and 46B. In some embodiments, rods 50A and 50B are interchangeable. In some embodiments, rods 50A and 50B comprise several axles 52 interconnected by a swivel joint, contemplating multiaxial configurations of rods 50A and 50B that can be installed on system 10.

In some embodiments, punching arms assemblies 20A and 20B respectively comprise hinge caps 54A and 54B. Hinge caps 54A and 54B are configured for providing protective cover to driving hinge 36 of gearing mechanism 28 protruding out of each one of motor housings 24A and 24B.

In some embodiments, system 10 for sparring training further comprises at least one power source 56. At least one power source 56 is operationally connectable to electric motor 26. At least one power source 56 is configured for supplying electrical energy to system 10. In some examples, at least one power source 56, in a non-limiting manner includes a rechargeable battery, non-rechargeable battery, magnetic induction coil, wired connection, an electric socket such as: micro-USB, mini-USB and USB-C.

In some embodiments, at least one power source 56 comprises a plurality of power source housings. Each of power source housing is associated and/or integrated with a respective punching arm assembly of punching arm assemblies 20A and 20B.

Figure 4:
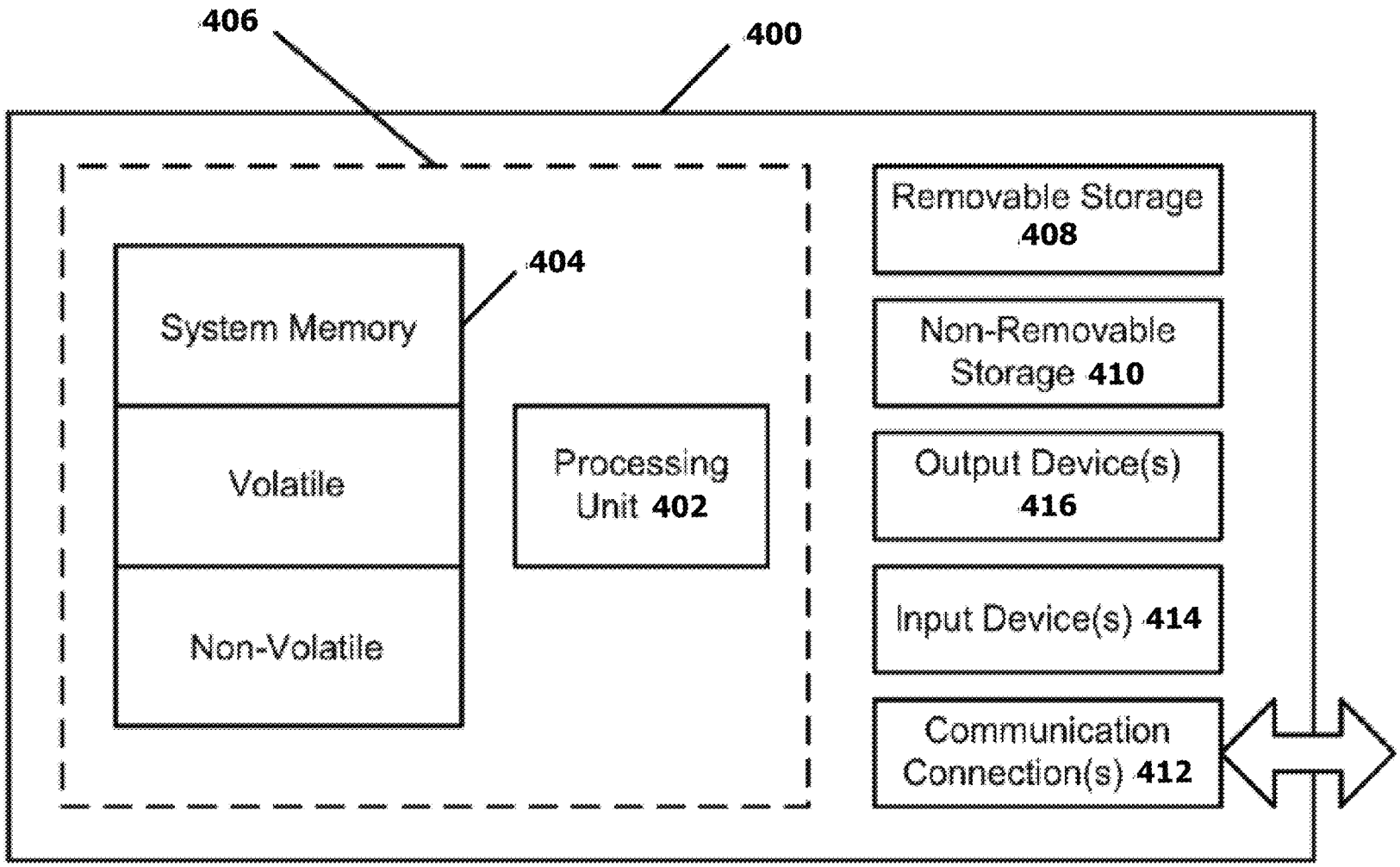
FIG. 4 is a schematic diagram of an exemplary computing environment.

In some embodiments, system 10 for sparring training further includes a computer memory, an electronic card, such as removable storage 408 shown in FIG. 4, and microprocessor on a PCB, such as processing unit 402 shown in FIG. 4, configured for operating system 10 in a preprogrammed operational mode. In some examples, the preprogrammed operational mode comprises a particular type of training session and/or parameters of training session and/or punching frequency and/or speed.

In some embodiments, the PCB further includes a wired and/or wireless transmitter configured for receiving programming and operation commands and/or providing data in a non-limiting manner from and/or to an external device such as, a smartphone, tablet, computer and/or server, allowing a trainee or a trainer to control one or more aspects of systems 10 individually or simultaneously.

In some embodiments, the PCB further includes a proximity sensor, allowing system 10 to detect whether a trainee is present in the proximity of system 10. System 10 is preferably actuated to drive the punching rods only upon a trainee is present in the proximity of system 10, thereby facilitating an interactive training.

Figure 5:
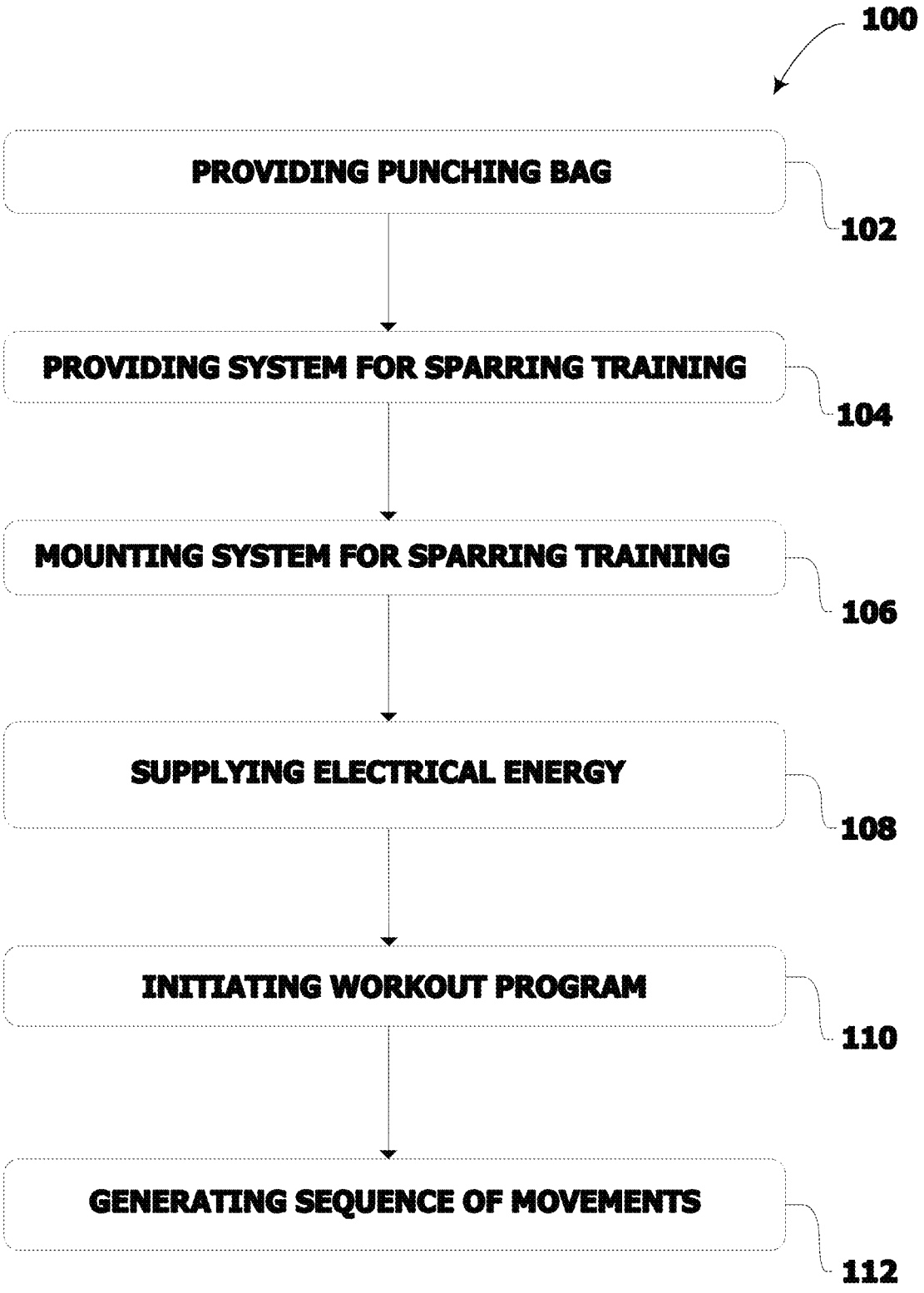
FIG. 5 is a flowchart of the method of sparring training, according to some embodiments of the present invention.

With reference to FIG. 4, an exemplary system for implementing aspects described herein includes a computing device, such as computing device 400. In its most basic configuration, computing device 400 typically includes at least one processing unit 402 and memory 404. Depending on the exact configuration and type of computing device, memory 404 may be volatile (such as random-access memory (RAM)), non-volatile (such as read-only memory (ROM), flash memory, etc.), or some combination of the two. This most basic configuration is illustrated in FIG. 5 by dashed line 406.

Computing device 400 may have additional features/functionality. For example, computing device 400 may include additional storage (removable and/or non-removable) including, but not limited to, magnetic or optical disks or tape. Such additional storage is illustrated in FIG. 4 by removable storage 408 and non-removable storage 410.

Computing device 400 typically includes a variety of computer readable media. Computer readable media can be any available media that can be accessed by computing device 400 and include both volatile and non-volatile media, and removable and non-removable media. Computer storage media include volatile and non-volatile, and removable and non-removable media implemented in any method or technology for storage of information such as computer readable instructions, data structures, program modules or other data. Memory 404, removable storage 408, and non-removable storage 410 are all examples of computer storage media. Computer storage media include, but are not limited to, RAM, ROM, electrically erasable program read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 400. Any such computer storage media may be part of computing device 400.

Computing device 400 may contain communications connection(s) 412 that allow the device to communicate with other devices. Computing device 400 may also have input device(s) 414 such as a keyboard, mouse, pen, voice input device, touch input device, etc. Output device(s) 416 such as a display, speakers, printer, etc. may also be included. All these devices are well known in the art and need not be discussed at length here.

It should be understood that the various techniques described herein may be implemented in connection with hardware or software or, where appropriate, with a combination of both. Thus, the processes and apparatus of the presently disclosed subject matter, or certain aspects or portions thereof, may take the form of program code (i.e., instructions) embodied in tangible media, such as floppy diskettes, CD-ROMs, hard drives, or any other machine-readable storage medium where, when the program code is loaded into and executed by a machine, such as a computer, the machine becomes an apparatus for practicing the presently disclosed subject matter.

Although exemplary implementations may refer to utilizing aspects of the presently disclosed subject matter in the context of one or more stand-alone computer systems, the subject matter is not so limited, but rather may be implemented in connection with any computing environment, such as a network or distributed computing environment. Still further, aspects of the presently disclosed subject matter may be implemented in or across a plurality of processing chips or devices, and storage may similarly be affected across a plurality of devices. Such devices might include PCs, network servers, and handheld devices, for example.

In accordance with some embodiments of the present invention, reference is now made to FIG. 5, showing a flowchart of method 100 for sparring training. Method 100 commences at step 102 of providing a punching bag. In some examples, punching bag 12 is speed bag, maize bag, slip nag, heavy bag, freestanding heavy bag, uppercut bag, wall bag.

In some embodiments, method 100 further includes step 104 of providing a system for sparring training. Step 104 further comprises the steps of attaching a plurality of punching arms assemblies to a gearing mechanism and/or mounting a hinge cap on a driving hinge of the gearing mechanism. In some embodiments, method 100 further comprises step 106 of mounting the system for sparring training onto the punching bag.

In some embodiments, method 100 further includes step 108 of supplying electrical energy to the portable device. In some embodiments, method 100 optionally comprises the steps of preprogramming the system for sparring training and/or feeding a workout program into a control module by using digital communication, such as direct communication via handheld devices, wireless and non-wireless, communication controlled via a network server, workout cards inserted to the control model in situ.

Subsequently to that the user optionally selects a specific workout program. In some examples, the selection of a specific workout program is performed via a mechanical selector, digital selector and/or wireless digital communication, such as from handheld devices.

In some embodiments, method 100 further includes step 110 of initiating a workout program. In a non-limiting manner, the program is initiated by the user, the system, a non-user operator such as an instructor. In some embodiments, method 100 optionally comprises the step of detecting a user presence.

In some embodiments, method 100 further includes step 112 of generating a sequence of movements of a plurality of punching arms assemblies. In some embodiments, method 100 optionally includes the step of collecting data. In some examples, in a non-limiting manner, data includes the type of program, duration of workout program, user information. The data is optionally saved in the system memory, in portable media, remote data storage or a user handheld device.

It will be appreciated by persons skilled in the art that the present invention is not limited by what has been particularly shown and described herein above. Rather the scope of the invention is defined by the claims which follow:

The invention claimed is:

1. A system for sparring training comprises:

a) a portable device for controlled sparring comprising:

(i) a fastener configured for mounting onto a punching bag, wherein said fastener is configured to assume:

(ii) an open configuration, wherein said fastener is configured to be threaded onto said punching bag and/or removed from said punching bag;

(iii) a closed configuration, wherein said fastener is configured to be precluded from being removed from said punching bag;

(iv) an interconnection mechanism configured for securing said fastener in said closed configuration;

b) a plurality of punching arms assemblies, wherein each one of said punching arms assemblies comprises:

(i) a mounting plate configured to be firmly attachable to said fastener;

(ii) a motor housing configured to be mounted onto said mounting plate;

(iii) an electric motor, encased within said motor housing;

(iv) a gearing mechanism, operationally connectable to said electric motor;

(v) a rod holder operationally connectable to said gearing mechanism;

(vi) a punching rod comprising at least one axle, wherein a proximal portion of said axle is configured for attachment to said rod holder;

c) at least one power source, operationally connectable to said electric motor, configured for supplying electrical energy to said system.

2. The system as in claim 1, further comprises a punching bag.

3. The system as in claim 2, wherein said punching bag comprises at least one element selected from the group consisting of: speed bag, maize bag, slip bag, heavy bag, freestanding heavy bag, uppercut bag, wall bag.

4. The system as in claim 1, wherein said fastener comprises a firm and flexible material.

5. The system as in claim 1, wherein said mounting plate is removably attachable to said fastener.

6. The system as in claim 1, further comprises least one element selected from the group consisting of: a screw, rivet, adhesive, bolt, bracket, mechanical fasteners, snap buttons, hook and loop fasteners, hooks, configured for removably attaching said mounting plate to said fastener.

7. The system as in claim 1, further comprises a securing mechanism configured for removably attaching said plurality of punching arms assemblies to said gearing mechanism.

8. The system as in claim 1, wherein each one of said plurality of punching arms assemblies further include a hinge cap, configured for providing protective cover to a driving hinge of said gearing mechanism.

9. The system as in claim 1, further comprises an electronic card and a microprocessor, configured for operating said system in a preprogrammed operational mode.

10. The system as in claim 1, wherein said at least one power source comprises at least one power source housings.

11. The system as in claim 1, further comprises a plurality of power source housings, wherein each one of said plurality of power source housing is associated with a respective punching arms assembly, of said plurality of punching arms assemblies.

12. A method for sparring training comprising:

a) providing a punching bag;

b) providing a system for sparring training comprises:

(I) a portable device for controlled sparring comprising:

(i) a fastener configured for mounting onto a punching bag, wherein said fastener is configured to assume: an open configuration and a closed configuration;

(ii) an interconnection mechanism configured for securing said fastener in said closed configuration;

(II) a plurality of punching arms assemblies, wherein each one of said punching arms assemblies comprises:

(i) a mounting plate configured to be firmly attachable to said fastener;

(ii) a motor housing configured to be mounted onto said mounting plate;

(iii) an electric motor, encased within said motor housing;

(iv) a gearing mechanism, operationally connectable to said electric motor;

(v) a rod holder operationally connectable to said gearing mechanism;

(vi) a punching rod comprising at least one axle, wherein a proximal portion of said axle is configured for attachment to said rod holder;

(III) at least one power source, operationally connectable to said electric motor, configured for supplying electrical energy to said system a) mounting said system onto said punching bag;

b) supplying electrical energy to said portable device;

c) initiating a workout program;

d) generating a sequence of movements of said plurality of punching arms assemblies.

13. The method as in claim 12, further comprises detecting a user presence with a proximity sensor.

14. The method as in claim 12, further comprises removably attaching said plurality of punching arms assemblies to said gearing mechanism.

15. The method as in claim 12, further comprises mounting a hinge cap on a driving hinge of said gearing mechanism.

16. The method as in claim 12, further comprises preprogramming said system with a desired operational mode and/or feeding a workout program into a control module using digital communication.

17. The method as in claim 12, further comprises selecting a specific workout program.

18. The method as in claim 12, comprises the step of collecting data.

19. A computer-readable storage medium, having computer-executable instructions stored thereon which, when executed by a computer micro-processor of a system for sparring training, comprising a portable device mountable on a punching bag, wherein said portable device comprising:

(i) a fastener configured for mounting onto said punching bag, wherein said fastener is configured to assume:

an open configuration, wherein said fastener is configured to be threaded onto said punching bag and/or removed from said punching bag;

a closed configuration, wherein said fastener is configured to be preclude from being removed from said punching bag;

(ii) an interconnection mechanism configured for securing said fastener in said closed configuration;

(iii) a plurality of punching arms assemblies on said portable device, wherein each one of said punching arms assemblies comprises:

a mounting plate configured to be firmly attachable to said fastener;

a motor housing configured to be mounted onto said mounting plate;

an electric motor, encased within said motor housing;

a gearing mechanism, operationally connectable to said electric motor;

a rod holder operationally connectable to said gearing mechanism;

a punching rod comprising at least one axle, wherein a proximal portion of said axle is configured for attachment to said rod holder;

(iv) at least one power source, operationally connectable to said electric motor, configured for supplying electrical energy to said system, wherein said computer-executable instructions stored on said computer-readable storage medium, when executed by said computer micro-processor, causing said system for sparring training to:

a) controllably supply electrical energy to said motor;

b) perform a predefined workout program;

c) generate a sequence of movements of said plurality of punching arms assemblies.

20. The computer-readable storage medium as in claim 19, further comprises computer-executable instructions, causing said system for sparring training to perform at least one operation selected from the group consisting of:

a) detecting a user presence with a proximity sensor;

b) collecting data;

c) selecting a specific workout program;

d) preprogramming said system with a desired operational mode;

e) operating a digital communication port;

f) interactively responding to movements of a user.

* * * * *